US007331422B2

(12) United States Patent
Wall

(10) Patent No.: US 7,331,422 B2
(45) Date of Patent: Feb. 19, 2008

(54) VORTEX MUFFLER

(76) Inventor: Alan Wall, 1055 Van Dyke Dr., Laguna Beach, CA (US) 92651

( * ) Notice: Subject to any disclaimer, the term of this patent is extended or adjusted under 35 U.S.C. 154(b) by 225 days.

(21) Appl. No.: 11/184,124

(22) Filed: Jul. 18, 2005

(65) Prior Publication Data

US 2007/0012511 A1 Jan. 18, 2007

(51) Int. Cl.

| | |
|---|---|
| ***F01N 1/08*** | (2006.01) |
| ***F01N 1/12*** | (2006.01) |
| *F01N 1/10* | (2006.01) |
| *F01N 1/04* | (2006.01) |
| *F01N 1/02* | (2006.01) |

(52) U.S. Cl. ..... 181/279; 181/274; 181/249

(58) Field of Classification Search ..... 181/279, 181/280, 281, 274, 270, 249, 248, 255, 256, 181/252

See application file for complete search history.

(56) References Cited

U.S. PATENT DOCUMENTS

| | | | | |
|---|---|---|---|---|
| 3,235,003 | A * | 2/1966 | Smith | 165/135 |
| 3,374,857 | A * | 3/1968 | Hutchins | 181/244 |
| 3,786,791 | A * | 1/1974 | Richardson | 123/65 EM |
| 3,885,935 | A * | 5/1975 | Nutter | 55/457 |
| 4,109,753 | A * | 8/1978 | Lyman | 181/252 |
| 4,325,459 | A * | 4/1982 | Martin | 181/248 |
| 4,371,053 | A * | 2/1983 | Jones | 181/249 |
| 4,690,245 | A * | 9/1987 | Gregorich et al. | 181/272 |
| 5,371,331 | A | 12/1994 | Wall | 181/227 |
| 5,892,186 | A * | 4/1999 | Flugger | 181/252 |
| 5,902,970 | A * | 5/1999 | Ferri | 181/249 |
| 5,962,822 | A | 10/1999 | May | 181/264 |
| 6,213,251 | B1 * | 4/2001 | Kesselring | 181/249 |
| 6,343,673 | B1 | 2/2002 | Chang | 181/227 |
| 6,385,967 | B1 * | 5/2002 | Chen | 60/312 |
| 6,679,351 | B2 | 1/2004 | Cummings et al. | 181/212 |
| 6,810,992 | B1 | 11/2004 | Lombardo | 181/227 |
| 2005/0011697 | A1 * | 1/2005 | Arlasky | 181/225 |
| 2005/0161283 | A1 * | 7/2005 | Emler | 181/249 |
| 2006/0076185 | A1 * | 4/2006 | Arlasky | 181/279 |

FOREIGN PATENT DOCUMENTS

JP 03264716 A * 11/1991

* cited by examiner

*Primary Examiner*—Edgardo San Martin
(74) *Attorney, Agent, or Firm*—Kenneth L. Green; Edgar W. Averill, Jr.

(57) ABSTRACT

A muffler includes an inner passage residing in an outer shell, and a stationary fan residing in the inner passage. The fan creates a vortex in a flow through the inner passage thus improving the flow and reducing the exhaust sound level. The inner passage includes an inner passage shell and the fan comprises vanes extending inward from the inner passage shell and turned at approximately a 45 degree angle to a centerline of the inner passage. Pinch zones at the entrance and exit from the inner passage further reduce the exhaust sound level. The inner passage shell is preferably a perforated inner passage shell, and a sound deadening material resides between perforated inner passage shell and the outer shell.

20 Claims, 3 Drawing Sheets

VORTEX MUFFLER

BACKGROUND OF THE INVENTION

The present invention relates to improving the efficiency of an internal combustion engine and in particular to a muffler which reduces exhaust system back pressure to improve engine performance.

The increasing cost of oil has motivated car owners and manufacturers to seek means to improve vehicle mileage. In particular, auto manufacturers seek to increase their market share and to satisfy government mileage requirements. Improvements to exhaust systems in the form of reduced restriction and tuned lengths have become commonplace and vehicle mileage has somewhat benefitted from such efforts. However, meeting federally mandated mileage requirements remains a challenge and further improvements are necessary.

Reducing pollution continues to be an important societal objective. Pollution levels in metropolitan areas remain unacceptably high at times, and create an immediate direct health issue for humans, and a longer term issue due to the damage to plant life. Automotive-based pollution remains an issue, and auto makers are continually challenged to reduce the emissions from new automobiles. Further, the emissions from older vehicles continue even if new vehicles achieve significant emission reductions.

Modern automobiles greatly benefit from Electronic Fuel Injection (EFI) systems and efficient intake manifold and head designs. As a result, new automobiles have greatly improved economy and reduced emissions. But while the intake aspect of engine design has advanced drastically, exhaust systems have not similarly advanced. U.S. Pat. No. 6,213,251 issued Apr. 10, 2001 for "Self Tuning Exhaust Muffler," describes a muffler having an outer tube and an inner louver tube, wherein a spiral vane extends outwardly from the louver tube to the outer tube and forms a helical passage for a flow between the louver tube and the outer tube. A multiplicity of "scoops" on the inside wall of the louvered tube "scoop" an outer portion of the flow through the louvered tube into the helical passage.

U.S. Pat. No. 6,679,351 issued Jan. 20, 2004 for "Air Turbine for Combustion Engine," describes an "air turbine" apparatus creating a rotational flow which creates a muffling effect without restricting flow. The apparatus of the '351 patent includes annular recesses (or convolutions) at the forward end (i.e., before the diameter increases) of the apparatus, which are intended to create a cyclone or vortex effect in the air flow. Following the annular recesses, the air flow enters an expansion chamber, wherein an airfoil is positioned at the front of the expansion chamber to split the air flow into a high velocity lower pressure outer vortex, and a lower velocity higher pressure inner vortex. The air foil is shown in several figures of the '351 patent, and clearly plays the dominant role in the flow characteristics of a muffler according to the '351 patent and is essential to the described invention. Further, in column 4, lines 22-25, the '351 patent states that "the ratio of air passing around the airfoil compared to the air passing through the airfoil for a six inch diameter expansion chamber is approximately 2.7 to 1," indicating that the air foil plays the dominant role on controlling air flow through the muffler. Additionally, FIG. 10 of the '351 patent shows an embodiment of the invention of the '351 patent which essentially consists of the annular rings and the airfoil, and the inner tube 22 is entirely absent.

Although attempts have been made to improve performance and efficiency through modifications to exhaust systems, there remains a need to improve overall engine performance, improve mileage, and reduce pollution.

BRIEF SUMMARY OF THE INVENTION

The present invention addresses the above and other needs by providing a muffler which includes an inner passage residing in an outer shell, and a stationary fan residing in the inner passage. The fan creates a vortex in a flow through the inner passage thus improving the flow and reducing the exhaust sound level. The inner passage includes an inner passage shell and the fan comprises vanes extending inward from the inner passage shell and turned at approximately a 45 degree angle to a centerline of the inner passage. Pinch zones at the entrance and exit from the inner passage further reduce the exhaust sound level. The inner passage shell is preferably a perforated inner passage shell, and a sound deadening material resides between perforated inner passage shell and the outer shell.

In accordance with one aspect of the invention, there is provided an engine muffler comprising an outer shell, an inner passage residing inside the outer shell, and a stationary fan residing inside the inner passage. The inner passage includes a perforated inner passage shell and a centerline. A space is defined between the inner passage shell and the outer shell and sound deadening material resides in the space. The fan comprises vanes angled at between approximately 30 degrees and approximately 60 degrees relative to the centerline of the inner passage, attached to the inner passage shell, and extending inwardly substantially reaching the centerline.

In accordance with another aspect of the invention, there is provided an engine muffler comprising an outer shell and an inner passage residing inside the outer shell. The inner passage has a perforated inner passage shell and a centerline. A first pinch zone resides at an inlet to the inner passage and a second pinch zone resides at an outlet to the inner passage. A space resides between the inner passage shell and the outer shell and a sound deadening material resides in the space. A stationary fan resides inside the inner passage. The fan comprises "D" shaped vanes angled at approximately 45 degrees relative to the centerline of the inner passage, attached to the inner passage shell, and extending inwardly, substantially reaching the centerline.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
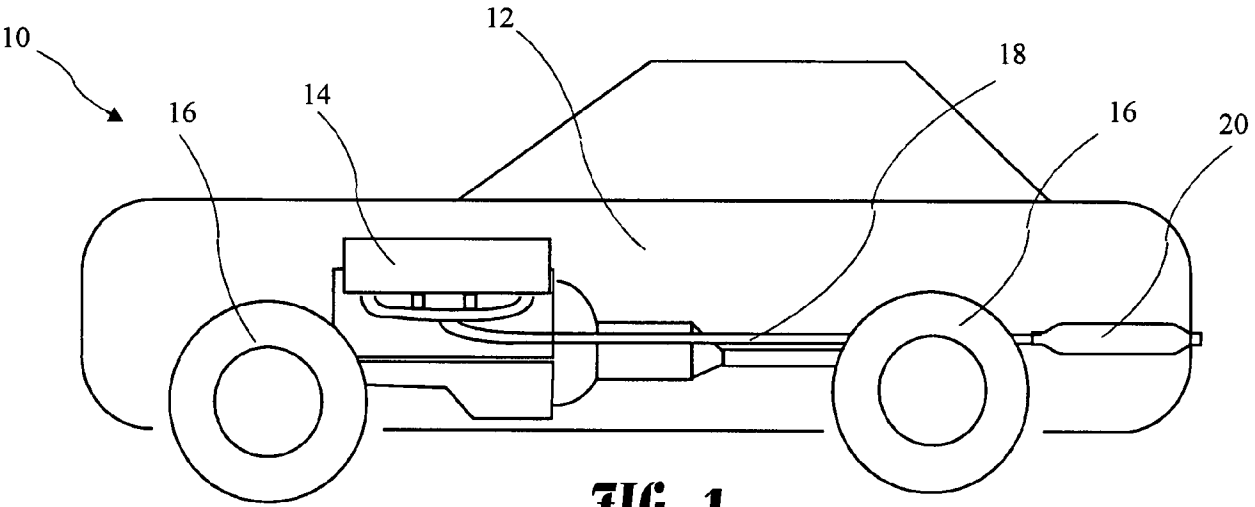
FIG. 1 is a car with a muffler according to the present invention.

A vehicle 10 including a body 12, an engine 14, and wheels 16 is shown in FIG. 1. The engine 14 consumes fuel and produces exhaust which passes through an exhaust pipe 18 and exits the vehicle through a vortex muffler 20 according to the present invention. The muffler 20 may be used independently, or in conjunction (for example, in sequence or in parallel) with other exhaust devices such as a catalytic converter or another muffler. In vehicles with two or more exhaust pipes 18, one muffler 20 may be used with each exhaust pipe 18.

Figure 2:
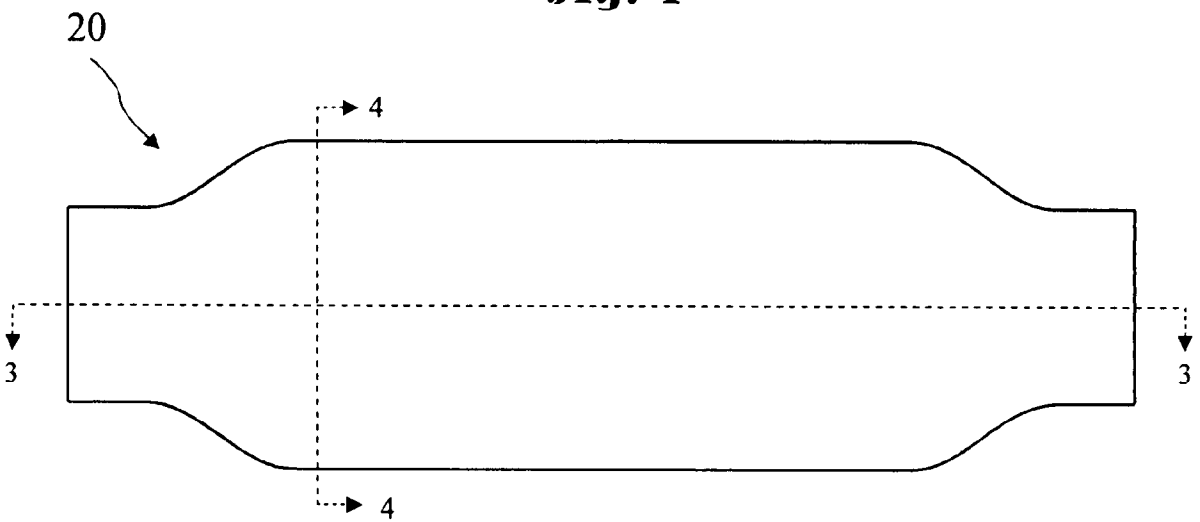
FIG. 2 is a side view of the muffler.
Figure 3:
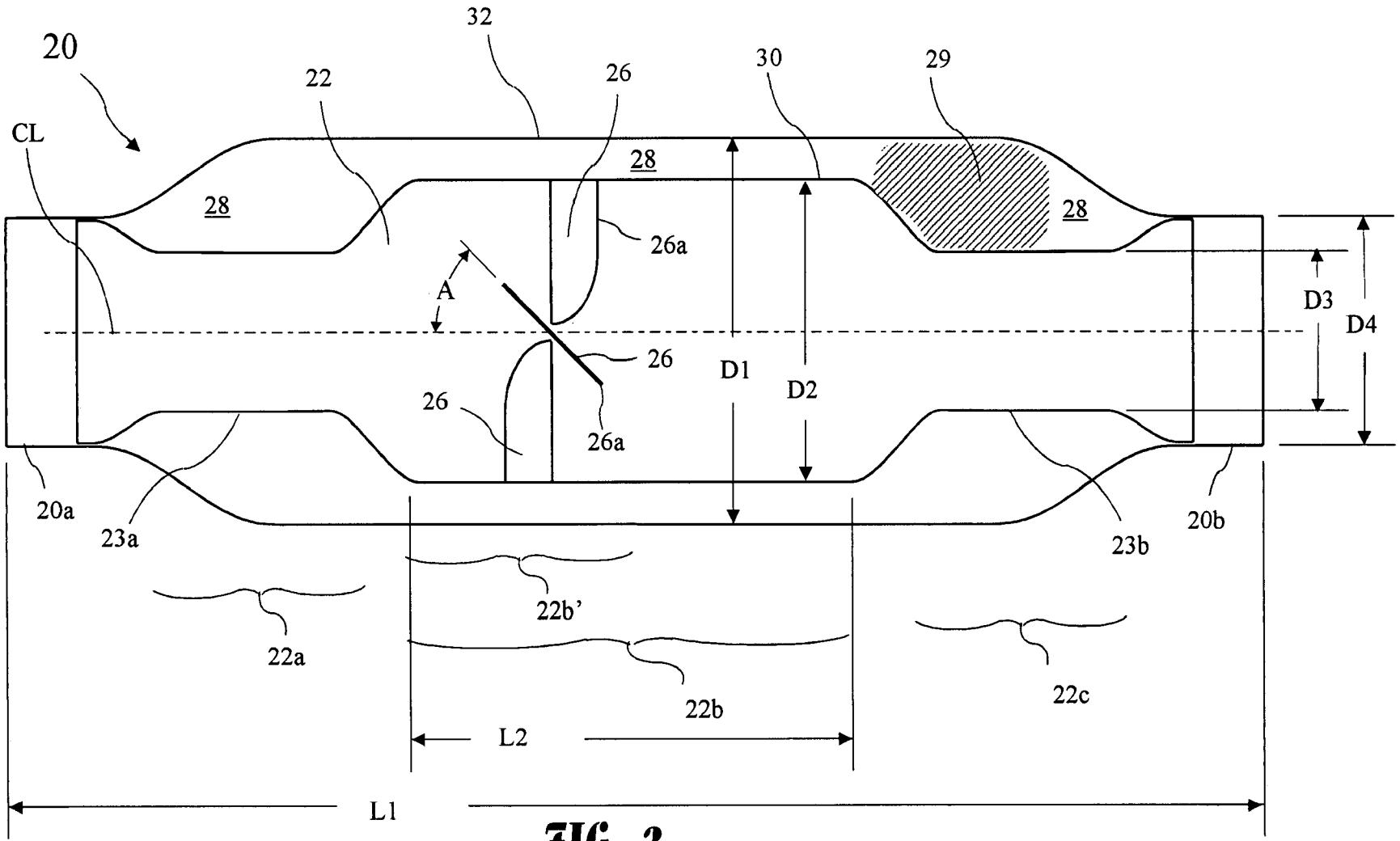
FIG. 3 is a cross-sectional view of the muffler taken along line 3-3 of FIG. 2.

A side view of the muffler 20 is shown in FIG. 2. A cross-sectional view of the muffler 20 taken along line 3-3 of FIG. 2 is shown in FIG. 3. The muffler 20 includes an inner passage 22. Substantially all of the flow through the muffler 20 passes through the inner passage 22. One embodiment of the muffler 20 includes an inner passage 22 with a perforated inner passage shell 30, and in this instance, some of the flow may escape the inner passage 22 through the perforations. A space 28 resides between the inner passage shell 30 and an outer shell 32. A sound deadening material 29 may reside in the space 28 to improve sound deadening of the muffler 20. The sound deadening material 29 may partially fill the space 28, or completely fill the space 28.

The inner tube 22 includes an inlet portion 22*a*, a center portion 22*b*, and an outlet portion 22*c*. The inlet portion 22*a* may include a first pinch zone 23*a* and/or the outlet portion 22*c* may include a second pinch zone 23*b* to further reduce sound levels. The muffler 20 has a diameter D1 which, for example, may be approximately five inches for a typical car muffler. The inner tube center portion 22*b* has a diameter D2 which, for example, may be approximately 3.5 inches for a typical car muffler. The pinch zones 23*a* and 23*b* have a diameter D3 which, for example, may be approximately two inches for a typical car muffler. The muffler inlet 20*a* and outlet 20*b* have diameters D4 which, for example, may be approximately 2.5 inches for a typical car muffler. The muffler 20 has an overall length L1 which, for example, may be approximately thirteen inches for a typical car muffler, and the inner tube center portion 22*b* has a length L2 which, for example, may be approximately six inches for a typical car muffler.

A fan comprising vanes 26 resides inside the inner passage 22 and creates a vortex in an air flow through the inner passage 22. The fan is preferably in a front half 22*b*' of the center portion 22*b*, and preferably, trailing edges 26*a* of the vanes 26 are approximately longitudinally centered in the center portion 22*b*. The vanes 26 are preferably flat and are preferably "D" shaped (see FIG. 6). The vanes 26 are angled relative to a center line CL of the inner passage 22, and the vanes 26 are preferably angled at an angle A between approximately 15 degrees and approximately 75 degrees from the centerline CL, and more preferably angled at an angle A between approximately 30 degrees and approximately 60 degrees from the centerline CL, and most preferably angled at an angle A approximately 45 degrees from the centerline CL.

The various angling of the blades 26 may correspond to the number of blades 26 in the muffler 20. For example, a four vane fan may preferably have blades angled at 45 degrees relative to the centerline CL, and a twelve vane fan may preferably have blades angled at 15 degrees (i.e., closer to parallel to the centerline CL) relative to the centerline CL. Further, greater sound attenuation may be achieved where necessary by greater angling (closer to perpendicular) relative to the centerline CL. In another example, a four vane fan may provide adequate sound attenuation for a turbocharged motor, and provide reduced back pressure, thus reducing turbo lag.

The inner passage 22 is preferably unobstructed except for the fan, but other objects may reside in the inner passage 22 which do not prevent the fan from creating a vortex in the flow through the inner passage 22, thus leaving the center passage 22 effectively unobstructed except for the fan.

Figure 4B:
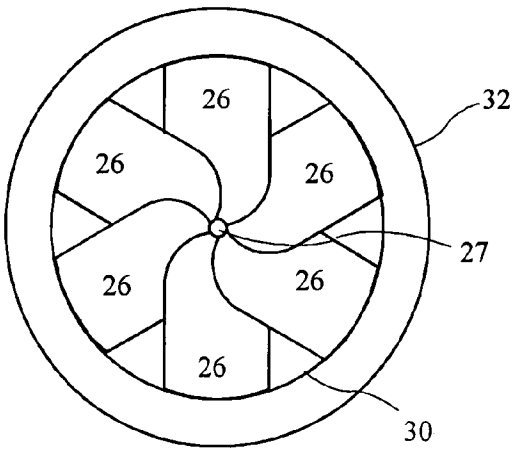
FIG. 4B is a cross-sectional view of a six vane muffler taken along line 4-4 of FIG. 2.
Figure 4A:
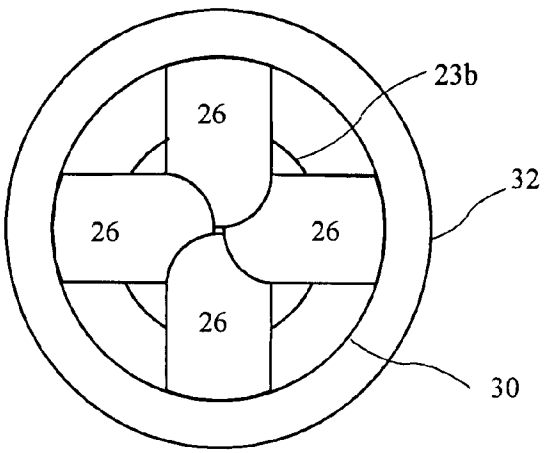
FIG. 4A is a cross-sectional view of a four vane muffler taken along line 4-4 of FIG. 2.

A cross-sectional view taken along line 4-4 of FIG. 2 shows a front view of a four vane embodiment of the fan in FIG. 4A, and cross-sectional view taken along line 4-4 of FIG. 2 shows a front view of a six vane embodiment of the fan in FIG. 4B. The six vane embodiment further shows a weld 27 connecting the vanes 26 proximal to the centerline CL (see FIG. 3). The inner passage 22 is preferably effectively empty aside from the vanes 26. The vanes 26 extend inwardly from the inner passage shell 30 to substantially reach the centerline, and preferably reach the center and are welded together to add additional structural strength to the inner passage 22. The fan preferably comprises three to twelve overlapping vanes 26, and more preferably comprises six overlapping vanes 26.

Figure 5:
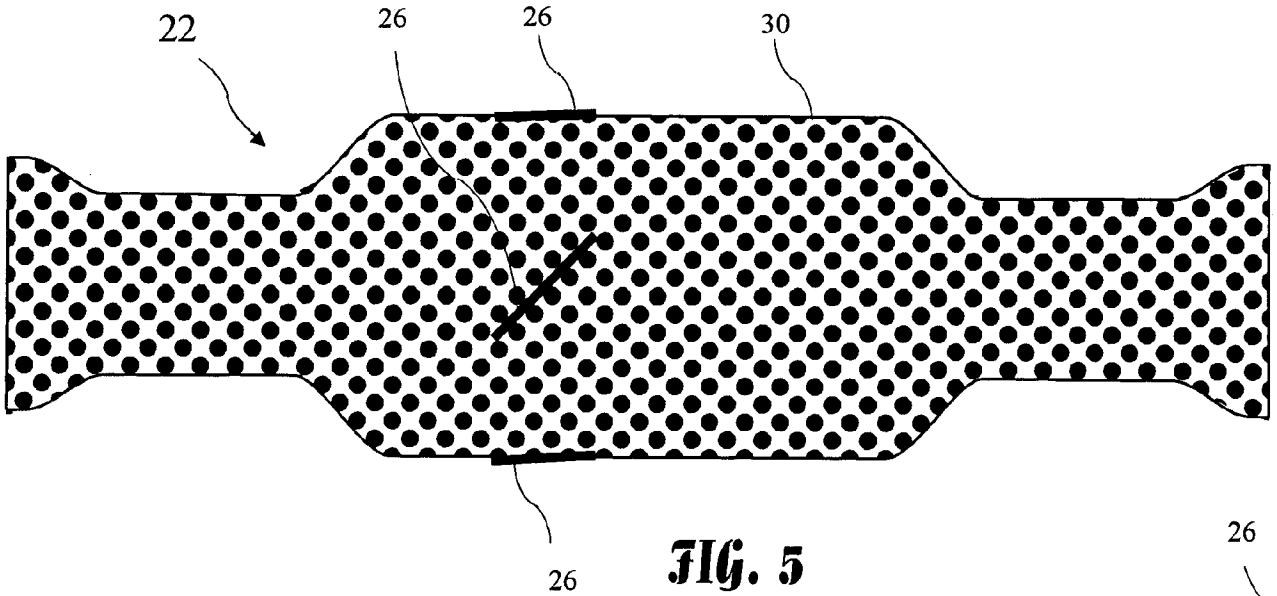
FIG. 5 is a side view of an inner passage of the muffler according to the present invention of the muffler.
Figure 6:
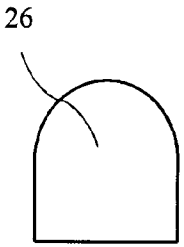
FIG. 6 is a vane according to the present invention.

A side view of the inner passage 22 including a perforated inner passage shell 30 is shown in FIG. 5. The blades 26 may be attached to the inner passage shell 30 by cutting slots in the inner passage shell 30, inserting the vanes 26 through the slots, and welding, brazing, or soldering the vanes 26 to the inner passage shell 30. A vane 26 suitable for attaching to the inner passage shell 30 is shown in FIG. 6. Alternatively, the vanes 26 may be a single casting, or may be a carbon fiber or carbon kevlar molding. Metal vanes may be made from, for example, steel, stainless steel, aluminum, or titanium. Stainless steel may be used to provide a long life. Carbon fiber, carbon kevlar, aluminum, or titanium may be used to provide light weight. Further, light weight vanes may be used with a light weight shell (for example, carbon fiber, carbon kevlar, or titanium) to make a very light weight racing muffler. Other shaped vanes may alternatively be used to construct the fan, which vanes may be curved.

In industrial applications such as generators, trucks, buses, heavy equipment, locomotives, and the like, vane counts of more than 12, (for example, 16 to as many as 36) may be preferred due to the size of the exhaust pipe, the amount of exhaust flow, and/or to obtain greater sound attenuation.

While the invention herein disclosed has been described by means of specific embodiments and applications thereof, numerous modifications and variations could be made thereto by those skilled in the art without departing from the scope of the invention set forth in the claims.

I claim:

1. An engine muffler comprising:

an outer shell;

an inner passage residing inside the outer shell, the inner passage having an inner passage shell and a centerline, the inner passage comprising:

an inlet portion for receiving an exhaust flow and including a first pinch zone having a reduced first diameter; and a center portion following the inlet portion and having an increased second diameter greater than the first diameter of the first pinch zone; and a stationary fan residing inside the center portion, the fan comprising overlapping vanes angled relative to the centerline of the inner passage and attached to the inner passage shell and extending inwardly substantially reaching the centerline.

2. The muffler of claim 1, wherein the inner passage shell is a perforated inner passage shell.

3. The muffler of claim 2, wherein a space between the inner passage shell and the outer shell is filled with a sound deadening material.

4. The muffler of claim 1, wherein the inner passage is effectively unobstructed except for the fan.

5. The muffler of claim 1, further including an outlet portion following the center portion and including a second pinch zone having a reduced third diameter smaller than the second diameter.

6. The muffler of claim 1, wherein the vanes are angled at between approximately 15 degrees and approximately 75 degrees from the centerline.

7. The muffler of claim 6, wherein the vanes are angled at approximately 45 degrees from the centerline.

8. The muffler of claim 1, wherein the vanes comprise flat "D" shaped vanes.

9. The muffler of claim 1, wherein the vanes comprise between three and twelve vanes.

10. The muffler of claim 9, wherein the vanes comprise six vanes.

11. The muffler of claim 9, wherein the vanes comprise one of three and four vanes for less back pressure on a turbocharged motor.

12. The muffler of claim 1, wherein the vanes are welded together proximal to the centerline.

13. An engine muffler comprising:

an outer shell;

a muffler inlet having an inlet diameter;

a muffler outlet having an outlet diameter;

an inner passage residing inside the outer shell, the inner passage having a perforated inner passage shell and a centerline, the inner passage comprising:

an inlet portion receiving an exhaust flow from the muffler inlet and including a first pinch zone having a reduced first diameter smaller than the inlet diameter;

a center portion following the inlet portion and having an increased second diameter greater than the first diameter of the first pinch zone; and an outlet portion following the center portion and including a second pinch zone having a reduced third diameter smaller than the second diameter of the center portion and smaller than the outlet diameter;

a space between the inner passage shell and the outer shell;

sound deadening material residing in the space; and a stationary fan residing inside the inner passage, the fan comprising vanes angled at between approximately 30 degrees and approximately 60 degrees relative to the centerline of the inner passage, the vanes attached to the inner passage shell, and the vanes extending inwardly substantially reaching the centerline.

14. The muffler of claim 13, wherein the vanes are turned at approximately 45 degrees from the centerline.

15. The muffler of claim 14, wherein vanes comprise flat "D" shaped vanes.

16. The muffler of claim 15, wherein vanes comprise four "D" shaped vanes.

17. The muffler of claim 13, wherein a first pinch zone resides at an inlet to the inner passage and a second pinch zone resides at an outlet to the inner passage.

18. An engine muffler comprising:

an outer shell;

a muffler inlet having an inlet diameter;

a muffler outlet having an outlet diameter;

an inner passage residing inside the outer shell, the inner passage receiving an exhaust flow from the muffler inlet and passing the exhaust flow to the muffler outlet, and having a perforated inner passage shell and a centerline, the inner passage including;

a cylindrical center portion residing in the inner passage and having a center diameter greater than the inlet diameter and greater than the outlet diameter; and a pinch zone residing after the center portion and having a smaller diameter smaller than the outlet diameter;

a space between the inner passage shell and the outer shell;

sound deadening material residing in the space; and a stationary fan residing inside the center portion, the fan comprising between four and six flat "D" shaped vanes angled at between approximately 30 degrees and approximately 60 degrees relative to the centerline of the inner passage, the vanes passing individually through slots cut in the inner passage shell and individually attached to the inner passage shell at the slots, and the vanes extending inwardly substantially reaching the centerline, wherein the inner passage is effectively unobstructed except for the fan.

19. The muffler of claim 18, wherein vanes comprise four flat "D" shaped vanes.

20. The muffler of claim 18, wherein the vanes are selected from the group consisting of vanes detached from one another and vanes welded together proximal to the centerline.

* * * * *